US009127400B2

(12) United States Patent
Herman et al.

(10) Patent No.: US 9,127,400 B2
(45) Date of Patent: Sep. 8, 2015

(54) METHOD AND APPARATUS FOR DRYING ARTICLES

(71) Applicant: Whirlpool Corporation, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 156 days.

(21) Appl. No.: 14/052,937

(22) Filed: Oct. 14, 2013

(65) Prior Publication Data

US 2015/0101207 A1 Apr. 16, 2015

(51) Int. Cl.
*D06F 58/26* (2006.01)

(52) U.S. Cl.
CPC ..... *D06F 58/26* (2013.01)

(58) Field of Classification Search
CPC ..... F26B 11/00; F26B 19/00; F26B 21/00; F26B 21/30; D06F 58/00; D06F 58/20; D06F 58/26; H05B 6/00; H05B 6/54
USPC ..... 34/259, 595, 601, 606, 610; 68/5 C, 5 R, 68/19, 20; 8/137, 149, 159; 219/772, 775, 219/778
See application file for complete search history.

(56) References Cited

U.S. PATENT DOCUMENTS 5,463,821 A * 11/1995 Gauer ..... 34/261
6,098,306 A * 8/2000 Ramsey et al. ..... 34/257
6,417,499 B2 * 7/2002 Blaker et al. ..... 219/778
6,423,955 B1 * 7/2002 Blaker et al. ..... 219/775
6,971,189 B1 * 12/2005 Anibas ..... 34/602
7,325,330 B2 * 2/2008 Kim et al. ..... 34/407
7,665,226 B2 * 2/2010 Tsuruta et al. ..... 34/259
7,921,578 B2 * 4/2011 McAllister et al. ..... 34/597
8,276,290 B2 * 10/2012 Uhara et al. ..... 34/275
8,387,272 B2 * 3/2013 Kim et al. ..... 34/524
8,387,274 B2 * 3/2013 Ashrafzadeh et al. ..... 34/528
8,572,865 B2 * 11/2013 Beers et al. ..... 34/601
8,667,702 B2 * 3/2014 Ediger et al. ..... 34/60
8,839,527 B2 * 9/2014 Ben-Shmuel et al. ..... 34/260
9,028,615 B2 * 5/2015 Eglmeier et al. ..... 134/1
2010/0115785 A1 * 5/2010 Ben-Shmuel et al. ..... 34/260
2011/0067186 A1 * 3/2011 Johansson ..... 8/137
2011/0308101 A1 12/2011 Wisherd et al.
2012/0096737 A1 * 4/2012 Kmet et al. ..... 34/443
2012/0192362 A1 * 8/2012 Lee et al. ..... 8/137
2012/0291304 A1 11/2012 Wisherd et al.

(Continued)

FOREIGN PATENT DOCUMENTS

DE 102008048706 A1 * 4/2010 ..... D06F 57/04
EP 2527517 A1 * 11/2012

(Continued)

*Primary Examiner* — Stephen M Gravini

(57) ABSTRACT

A method for drying laundry with a radio frequency (RF) applicator having a plurality of baffles on a drum rotatable on a non-vertical axis, an anode element in at least one first baffle and a cathode element in at least one second baffle, the method including capacitively coupling the anode element to the cathode element, and energizing the RF applicator to generate a field of electromagnetic radiation (e-field) between the anode element and the cathode element, wherein liquid in the laundry residing within the e-field will be dielectrically heated to effect a drying of the laundry.

26 Claims, 6 Drawing Sheets

(56) References Cited

U.S. PATENT DOCUMENTS

| | | | | |
|---|---|---|---|---|
| 2015/0033806 | A1* | 2/2015 | Cerrato et al. | 68/5 C |
| 2015/0052774 | A1* | 2/2015 | Herman et al. | 34/255 |
| 2015/0101207 | A1* | 4/2015 | Herman et al. | 34/255 |

FOREIGN PATENT DOCUMENTS

| | | | | |
|---|---|---|---|---|
| GB | 2462725 A * | 2/2010 | | B65D 55/02 |
| WO | WO 0146509 A1 * | 6/2001 | | D06F 39/00 |

* cited by examiner

METHOD AND APPARATUS FOR DRYING ARTICLES

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects associated with random application of the waves in a traditional microwave. Radio frequencies and their corresponding controlled and contained RF electronic fields (e-fields) are typically used for drying of textile material.

When applying an e-field to a wet article, such as a clothing material, the e-field may cause the water molecules within the e-field to dielectrically heat, generating thermal energy which effects the rapid drying of the articles.

BRIEF DESCRIPTION OF THE INVENTION

One aspect of the invention is directed to a method for drying laundry with a radio frequency (RF) generator connected to an applicator having a plurality of baffles on a drum rotatable on a non-vertical axis, an anode element in at least one first baffle and a cathode element in at least one second baffle, the method including capacitively coupling the anode element to the cathode element, and energizing the RF generator to generate a field of electromagnetic radiation (e-field) within the radio frequency spectrum between the anode element and the cathode element, wherein liquid in the laundry residing within the e-field will be dielectrically heated to effect a drying of the laundry.

Another aspect of the invention is directed to a laundry treating applicator for drying laundry according to a predetermined cycle of operation, including a laundry support element, a plurality of baffles at least partially spaced from each other and supported by the laundry support element wherein a first baffle further comprises an anode element and a second baffle further comprises a cathode element, a capacitive coupling between the anode element and the cathode element, and a radio frequency (RF) generator coupled to the anode element and the cathode element and selectively energized to generate electromagnetic radiation in the radio frequency spectrum. The energization of the RF generator sends electromagnetic radiation through the applicator via the capacitive couple to form a field of electromagnetic radiation (e-field) in the radio frequency spectrum to dielectrically heat liquid within laundry within the e-field.

DESCRIPTION OF EMBODIMENTS OF THE INVENTION

While this description may be primarily directed toward a laundry drying machine, the invention may be applicable in any environment using a radio frequency (RF) signal application to dehydrate any wet article. While the term "laundry" may be used to describe the materials being dried, it is envisioned that embodiments of the invention may be used to dry any textiles, for instance, clothing, articles, etc.

Figure 1:
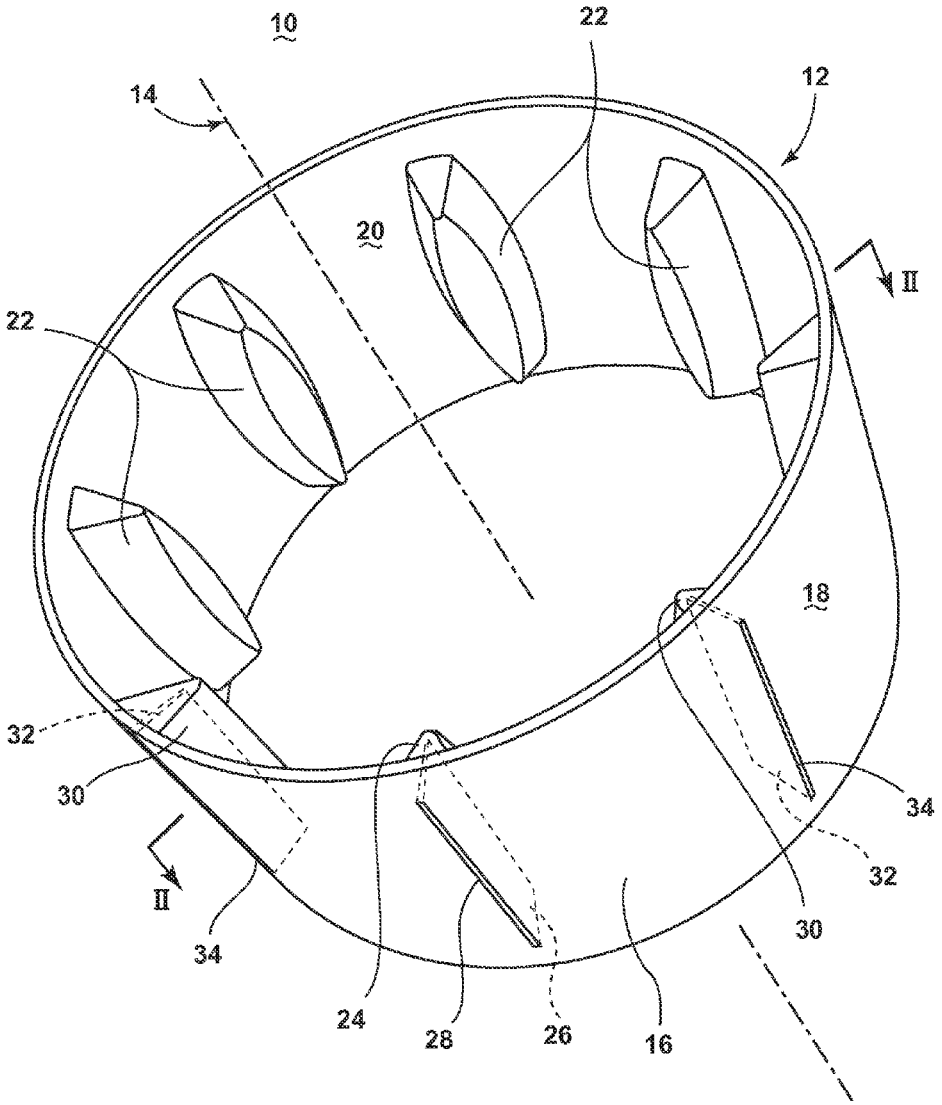
FIG. 1 is a schematic perspective view of the laundry treating applicator in accordance with the first embodiment of the invention.

FIG. 1 is a schematic illustration of a laundry treating applicator 10 according to the first embodiment of the invention for dehydrating one or more articles, such as articles of clothing. As illustrated in FIG. 1, the laundry treating applicator 10 has a drum 12 configured to rotate about a non-vertical rotational axis 14. The drum 12 further includes a support element 16 having a non-conducting outer surface 18 and a non-conductive inner surface 20 for receiving and supporting wet laundry. The inner surface further includes non-conductive tumble elements, such as a plurality of at least partially, circumferentially, spaced baffles 22, to enable or prevent movement of laundry. While eight baffles 22 are shown, alternative numbers of baffles 22 are envisioned.

At least one first baffle 24 further includes a conductive element, such as an anode element 26, fixedly coupled with and positioned inside the at least one first baffle 22 such that the anode element 26 is electrically isolated from the laundry. At least one anode contact point 28 extends through the support element 16 and is exposed on the outer surface 18 of the drum 12. Similarly, at least one second baffle 30, adjacent to the at least one first baffle 24, further includes a conductive element, such as a cathode element 32, fixedly coupled with and positioned inside the at least one second baffle 30 such that the cathode element 32 is electrically isolated from the laundry and the anode element 26. At least one cathode contact point 34 extends through the support element 16 and is exposed on the outer surface 18 of the drum 12.

The surface area of each anode and/or cathode contact point 28, 34 exposed on the outer surface 18 of the drum 12 may vary from the illustrated example so that the contact points 28, 34 may be easier to couple with. For example, the anode and/or cathode contact points 28, 34 may be alternatively configured in axially spaced conductive strips that extend for a radial segment on the outer surface 18 of the drum 12. Additionally, each anode and cathode element 26, 32 may be fixedly coupled to the support element 16 or to the respective baffle 24, 30 by, for example, adhesion, fastener connections, or laminated layers. Alternative mounting techniques may be employed.

As illustrated, the laundry treating applicator 10 may have one first baffle 24 with two second baffles 30, one on each immediately adjacent side of the first baffle 24. Alternative embodiments are envisioned where, for instance, three second baffles 30 are adjacently alternated with two first baffles 24 such that consecutive baffles 22 each include a first or second baffle 24, 30. Another embodiment is envisioned wherein one set of first and second baffles 24, 30 is radially opposed by a second set of first and second baffles 24, 30. While it is envisioned that each first baffle 24 with anode element 26 may have multiple second baffles 30 with cathode elements 32, alternate configurations are envisioned wherein there is one second baffle 30 for each first baffle 24. Moreover, a configuration is envisioned wherein each of the plurality of baffles 22 are adjacently alternating first and second baffles 24, 30, spaced about a portion of, or the entire drum 12. Additionally, while each anode and cathode element 26, 32 is shown extending the axial length of each respective first and second baffle 24, 30, alternative lengths and placements are envisioned, for instance, an element 26, 32 that is half the axial length of the baffle 24, 30 and is positioned at either axial end of the baffle 24, 30.

The support element 16 of the drum 12 may be made of any suitable low loss, fire retardant materials that isolate the conductive elements from the articles to be dehydrated. While a support element 16 is illustrated, other non-conductive elements are envisioned, such as one or more segments or layers of non-conductive elements, or alternate geometric shapes of non-conductive elements.

Figure 2:
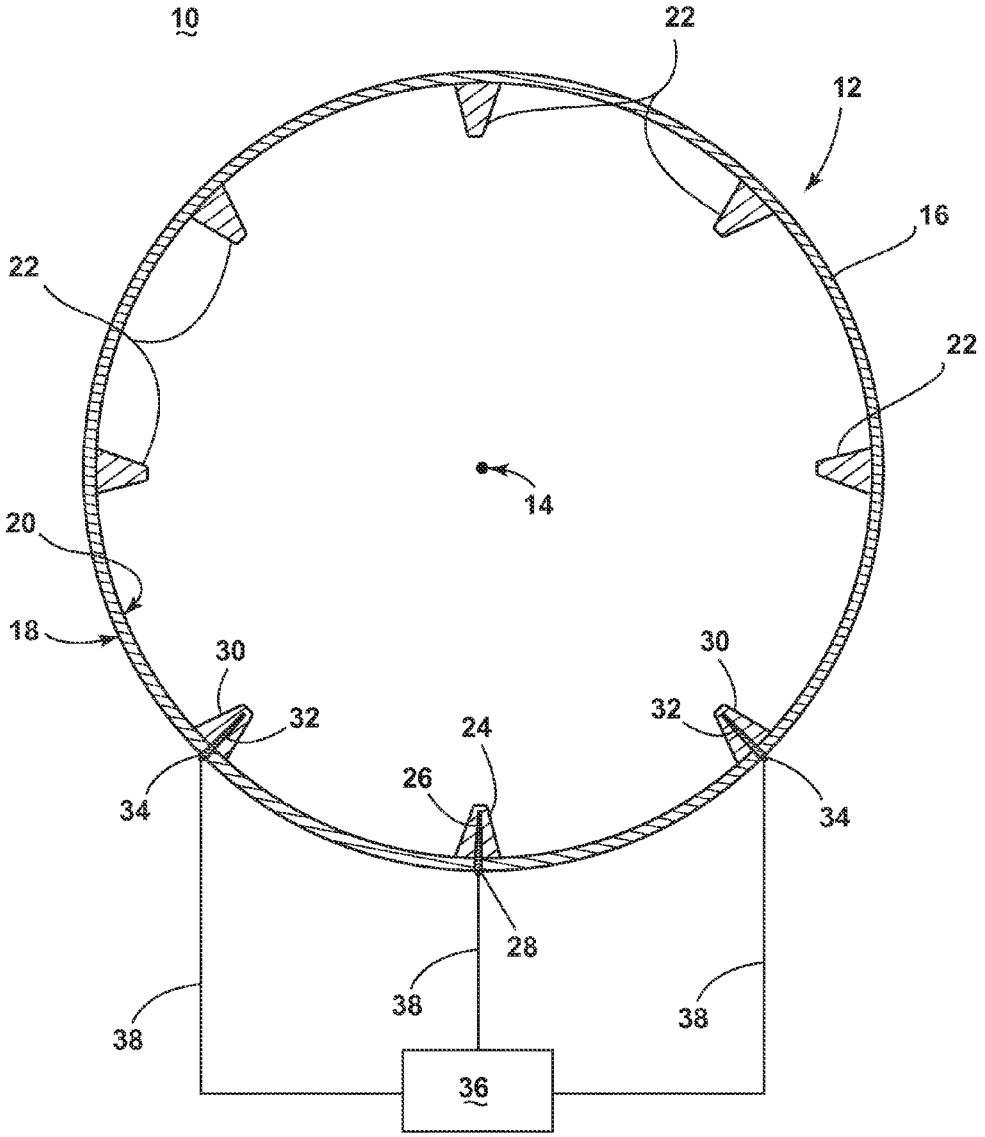
FIG. 2 is a partial sectional view taken along line 2-2 of FIG. 1 in accordance with the first embodiment of the invention.

Turning now to FIG. 2, the laundry treating applicator 10 further includes an RF generator 36 configured to be selectively energized to generate a field of electromagnetic radiation (e-field) within the radio frequency spectrum between outputs electrodes and may be electrically coupled, for instance, via conductors 38 with the anode and cathode elements 26, 32 at each respective anode and cathode contact point 28, 34. One such example of an RF signal generated by the RF generator 36 may have a frequency of 13.56 MHz. The generation of another RF signal, or varying RF signals, is envisioned.

Microwave frequencies are typically applied for cooking food items. However, their high frequency and resulting shorter wavelength make microwave frequencies undesirable for drying laundry articles. Radio frequencies and their corresponding lower dielectric heating effect are typically used for drying of laundry. In contrast with a conventional microwave heating applicator, where microwaves generated by a magnetron are directed into a resonant cavity by a waveguide, the RF generator 36 induces a controlled electromagnetic field between the anode and cathode elements 26, 32. Stray-field or through-field electromagnetic heating provides a relatively deterministic application of power as opposed to conventional microwave heating technologies where the microwave energy is randomly distributed (by way of a stirrer and/or rotation of the load). Consequently, conventional microwave technologies may result in thermal runaway effects or arcing that are not easily mitigated when applied to certain loads (such as metal zippers etc.). Stated another way, using a water analogy where water is analogous to the electromagnetic radiation, a microwave acts as a sprinkler while the above-described RF generator 36 is a wave pool. It is understood that the differences between microwave ovens and RF dryers arise from the differences between the implementation structures of applicator vs. magnetron/waveguide, which renders much of the microwave solutions inapplicable for RF dryers.

The coupling between the RF generator 36 and the anode and cathode elements 26, 32 may be fixed or removable. For example, if the drum 12 is stationary while the laundry is agitated, a fixed coupling is envisioned. However, if the drum 12 rotates about the rotational axis 14, a semi-fixed coupling is envisioned, for instance, through slip rings at the point of rotation. Alternatively, if the drum 12 rotates about the rotational axis 14, a coupling is envisioned wherein, upon a stopping, slowing, or continuation of the rotation, moveable elements (not shown) may, for example, actuate in order to make contact with the respective anode and cathode contact points 28, 34. It is also envisioned that all anode elements 26 configured in the laundry treating applicator 10 will be coupled with the same RF signal from the RF generator 36. Likewise, it is envisioned that all cathode elements 32 will be coupled with the same RF signal from the RF generator 36, or a common ground from the laundry treating applicator 10. Alternatively, different or varying RF signals may be transmitted to multiple anode and/or cathode elements 26, 32.

During operation, a laundry load of one or more wet laundry articles is placed on the inner surface 20 of the laundry treating applicator 10, and the drum 12 may rotate at various speeds in either rotational direction according to a predetermined cycle of operation. In particular, the rotation of the drum 12 in combination with the physical interaction between the plurality of baffles 22 and the laundry load at various speeds causes various types of laundry movement inside the drum 12. For example, the laundry load may undergo at least one of tumbling, rolling (also called balling), sliding, satellizing (also called plastering), or combinations thereof. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly.

Figure 3:
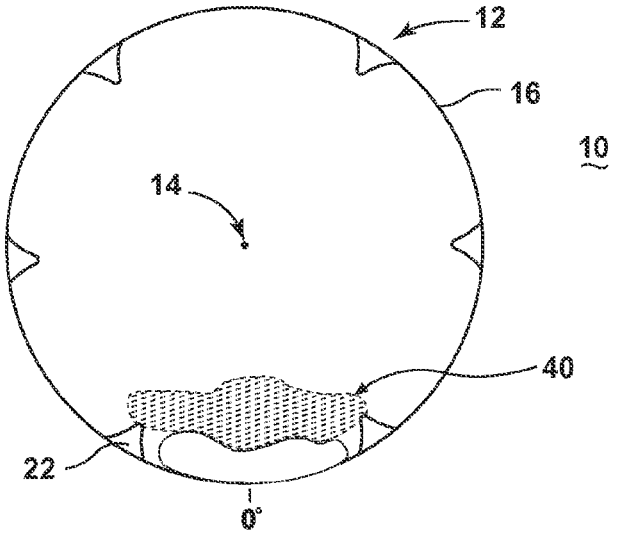
FIGS. 3-5 schematically illustrate, sequentially, a fabric load in a drum of the laundry treating applicator of FIG. 1 as the drum rotates and stops, which results in a flipping over of the fabric load.
Figure 4:
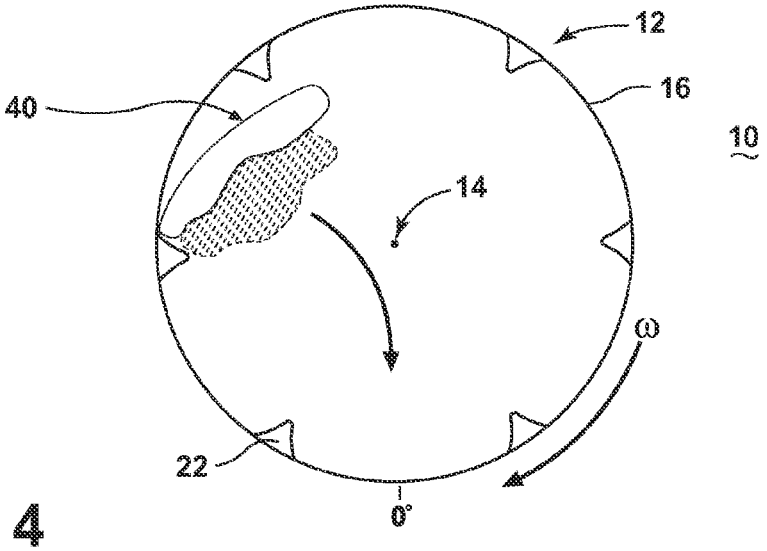
Figure 5:
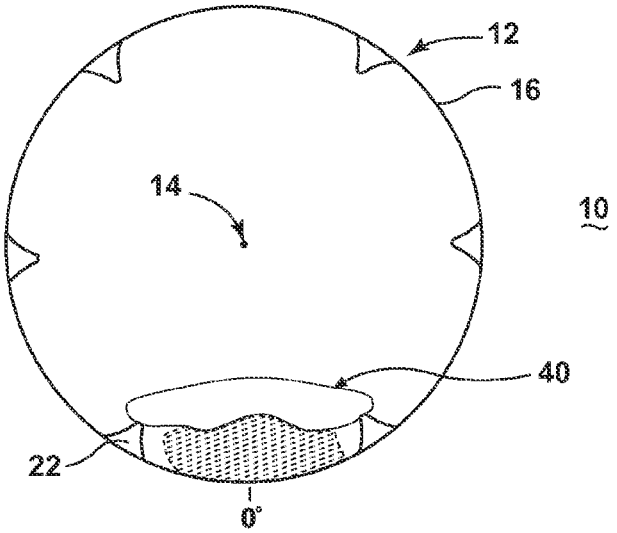

During tumbling, the drum 12 may be rotated at a tumbling speed such that the fabric items of the laundry load rotate with the drum 12 and are lifted from a lowest location towards a highest location by the plurality of baffles 22, but fall back to the lowest location before reaching the highest location. Typically, the centrifugal force applied by the drum 12 to the fabric items at the tumbling speeds is less than about 1 G. FIGS. 3-5 illustrate such a lifting/falling movement using an exemplary laundry load 40 comprising multiple fabric items, which for convenience of illustration, is shown as having an upper portion (with dots) and a lower portion (without dots). In FIG. 3, the laundry load is illustrated as sitting at the lowest location, indicated as 0°, of the drum 12. As the drum 12 is rotated at some angular rate, indicated as to, the laundry load 40 may follow along with the movement of the drum 12 and be lifted upwards as shown in FIG. 4. The lifting of the laundry load 40 with the drum 12 may be facilitated by either or both the centrifugal force acting on the laundry load and the lifting force applied by the baffles 22. As the laundry load 40 may be lifted up towards the highest location it eventually reaches a point where it will fall as indicated by the arrow in FIG. 4. The laundry load 40 will fall back to the lowest location as illustrated in FIG. 5. Depending upon the speed of rotation and the fabric items making up the laundry load 40, the laundry may fall off from the drum 12 at various points.

When the laundry load 40 falls back to the lowest location it may be flipped such that fabric items that were previously located on the bottom of the laundry load 40 are now located on the top of the laundry load 40. This physical phenomena results from the falling motion of the laundry load 40 in the drum 12. It should be noted that while a complete or perfect flipping of the laundry load 40 during falling may not occur, during every falling the fabric items in the laundry load 40 are often redistributed to some extent within the drum 12. After the laundry load 40 is returned to the lowest location, the process may be repeated or other control actions may be initiated within the laundry treating applicator 10. During the flipping action, the movement of the laundry load 40 through the cavity of the drum 12 may allow water to evaporate from the load 40. This process helps remove water that may otherwise be confined by the bundled laundry load 40. Additionally, using a signal from the RF generator 36, such as an applied voltage across the anode and cathode elements 26, 32, the laundry treating applicator 10 may determine if wet or damp parts of the laundry load 40 are between the elements 26, 32, and may re-tumble the load 40 in response to this determination.

The drum 12 may cease rotation at a predetermined position, for instance, aligning the anode and cathode contact points 28, 34 with the anode and cathode elements 26, 32, The predetermined position may also be defined wherein at least one set of first and second baffles 24, 30 is located beneath the horizontal axis of the drum 12. In this predetermined position, gravity will distribute the at least a portion of the laundry load 40 between the at least first and second baffles 24, 30.

The laundry treating applicator 10 creates a capacitive coupling between the at least one anode element 26 and the at least one cathode element 32. The RF generator 36 may be continuously or intermittently energized to generate an e-field between the capacitively coupled anode and cathode elements, and which interacts with liquid in the laundry load 40. The liquid residing within the e-field, located above at least a portion of the inner surface 20 of the drum 12, will be dielectrically heated to effect a drying of the laundry load 40. The anode element 26 may capacitively couple to each adjacent cathode elements 32, whereupon the RF generator 36 will generate an e-field between each anode/cathode coupling.

The laundry treating applicator 10 may then cease the energization of the e-field, and initiate at least a partial rotation of the drum 12 to tumble the laundry load 40. The process of tumbling and selective energization of the e-field may continue for one or more cycles until the drying of the laundry load 40 has completed, as determined by sensors, timing, or the predetermined cycle of operation.

Many other possible configurations in addition to that shown in the above figures are contemplated by the present embodiment. For example, one embodiment of the invention contemplates different geometric shapes for the plurality of baffles 22 in the laundry treating applicator 10. Additionally, another example of the embodiment having more than one capacitive coupling sets of anode and cathode elements 26, 32 contemplates selectively energizing individual sets, all sets, or fewer than all sets. The selective energizing of individual sets, all sets, or fewer than all sets may be further related to the rotation of the drum 12, a predetermined position of the drum 12 during a continued or slowed rotation, or a predetermined stopped position of the drum 12.

The selective energizing of individual sets, all sets, or fewer than all sets may be further related to a determination of an impedance for the laundry load 40 or portion of the load 40, which may be indicative of wet laundry, and energizing individual sets, all sets, or fewer than all sets in response to the determination of the impedance. The selective energization may only energize the portion or portions of capacitive coupling sets positioned at or near the wet laundry.

Figure 6:
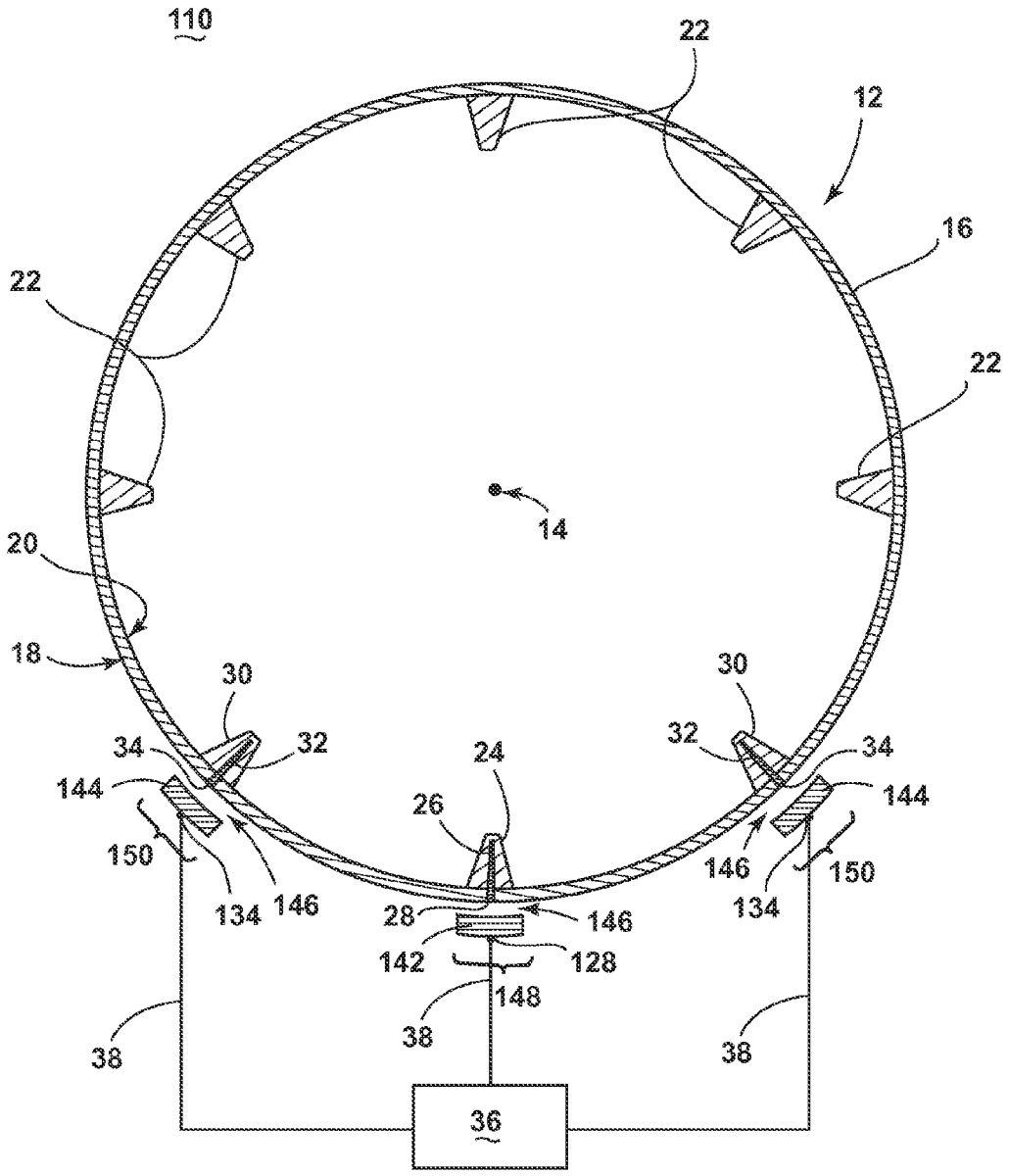
FIG. 6 is a partial sectional view showing an alternate assembled configuration of the drum and anode/cathode elements, in accordance with the second embodiment of the invention.

FIG. 6 illustrates an alternative laundry treating applicator 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that each anode and cathode element 26, 32 further includes a respective conductive second anode element 142 and a conductive second cathode element 144, each spaced from the element 26, 32 by, for example, an air gap 146. Alternate configurations are envisioned where only at least a portion of the drum 12, or other non-conducting element, separates the second anode and/or cathode elements 142, 144 from their respective anode and/or cathode elements 26, 32. It may be envisioned that additional materials may be layered between the anode and cathode elements 26, 32, 142, 144.

Each second anode element 142 defines at least a partial first ring segment 148, while each second cathode element 144 defines at least a partial second ring segment 150 which may be different from the first segment 148. In this embodiment, the second anode and cathode elements 142, 144 may be fixedly mounted to a stationary (i.e. non-rotating) portion of the laundry treating applicator 110 such that the drum 12 rotates relative to the stationary elements 142, 144. Additionally, the RF generator 36 is electrically coupled with the second anode and cathode elements 142, 144 at respective anode and cathode contact points 128, 134.

The second embodiment of the laundry treating applicator 110 is configured such that the applicator 110 may create a first capacitive coupling between each anode element 26 and second anode element 142, a second capacitive coupling between each cathode element 32 and the second cathode element 144, and a third capacitive coupling between the anode and cathode elements 26, 32.

During drying operations, the drum 12 may rotate about the rotational axis 14. After ceasing rotation in a predetermined position such that at least a portion of each second anode and cathode elements 142, 144 aligns with a portion of each respective anode and cathode elements 26, 32, the RF generator 36 may be continuously or intermittently energized to generate an e-field between the first, second, and third capacitive couplings which interacts with liquid in the laundry. The liquid interacting with the e-field located within the inner surface 20 will be dielectrically heated to effect a drying of the laundry.

Additionally, alternate examples of the second embodiment of the invention may have more than one capacitive coupling sets of anode and cathode elements 26, 32, 142, 144. Similar to the first embodiment, the second embodiment contemplates selectively energizing individual sets, all sets, or fewer than all sets of capacitive couplings. The selective energizing of individual sets, all sets, or fewer than all sets may be further related to the rotation of the drum 12, or may be timed to correspond with one of aligned capacitive couplings, tumbling of the laundry, a predetermined position of the drum 12 during a continued or slowed rotation, a predetermined stopped position of the drum 12, an applied RF signal (such as voltage) may be used to detect alignment of the anode and cathode elements 226, 232, or power requirements of the laundry treating applicator 110. In another configuration, the second anode and cathode elements 142, 144 may encircle larger or smaller radial segments, or may completely encircle the drum 12 at axially spaced radial segments, as opposed to just partially encircling the drum 12.

Figure 7:
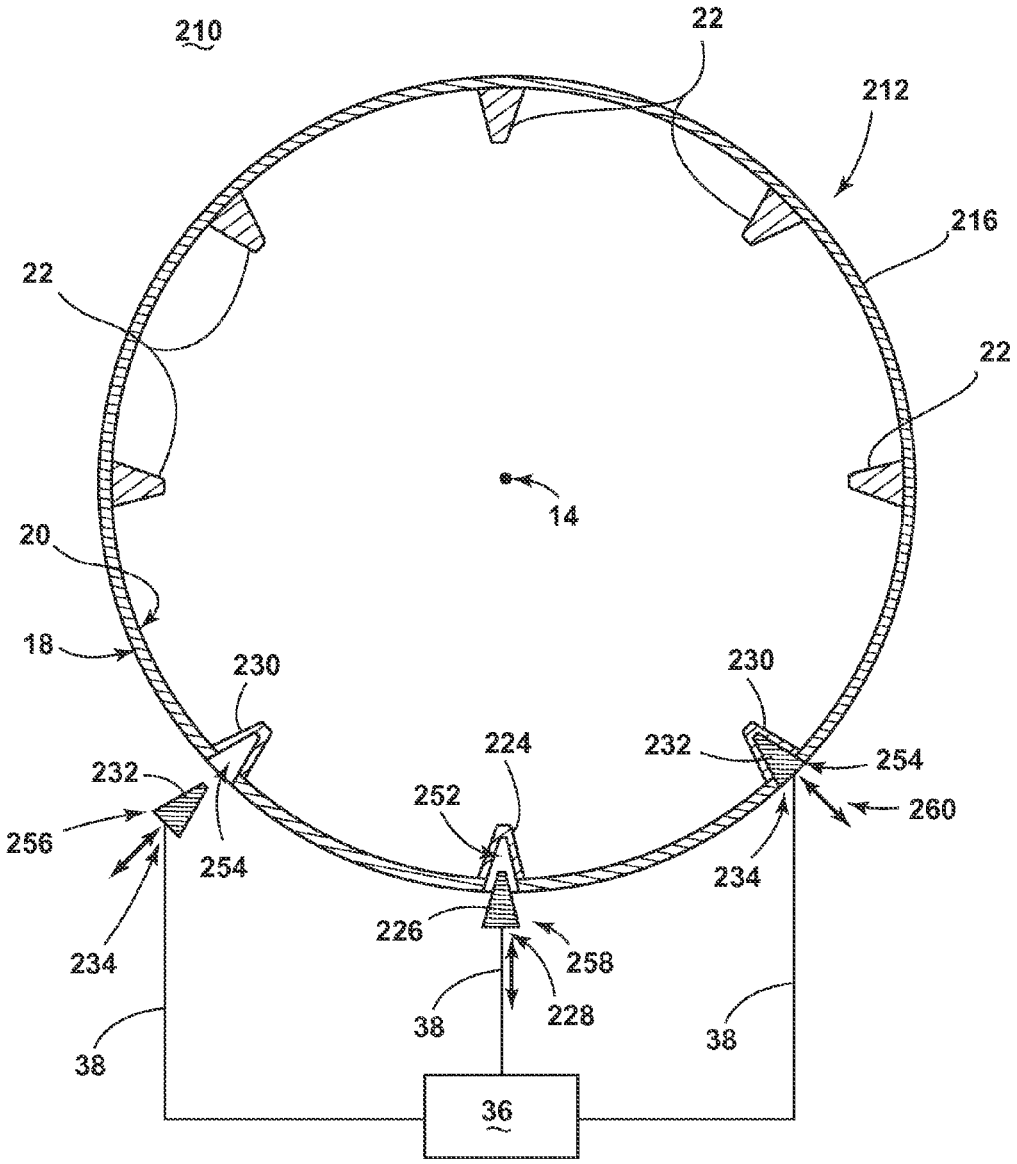
FIG. 7 is a partial sectional view showing an alternate assembled configuration of the drum and anode/cathode elements, in accordance with the third embodiment of the invention.

FIG. 7 illustrates an alternative laundry treating applicator 210 according to a third embodiment of the invention. The third embodiment may be similar to the first and second embodiments; therefore, like parts will be identified with like numerals increased by 200, with it being understood that the description of the like parts of the first embodiment applies to the second embodiment, unless otherwise noted. A difference between the first and second embodiments and the third embodiment may be that each anode and cathode element 226, 232 may be moveable, and receivable into respective receptacles 252, 254, in the respective first and second baffles 224, 230. In this embodiment, the RF generator 36 is electrically coupled with the moveable anode and cathode elements 226, 232 at respective anode and cathode contact points 228, 234, fixedly configured to retain electric coupling regardless of the position or movement of the elements 226, 232.

During drying operations, the drum 212 may rotate about the rotational axis 14. The rotating drum 212 then ceases rotation in a predetermined position such that the receptacles 252, 254 align with the respective anode and cathode elements 226, 232. The anode and cathode elements 226, 232 are then actuated into the respective receptacles, illustrated, such as 256 wherein the element is completely withdrawn from the receptacle 254, 258 wherein the element is partially inserted into the receptacle 252, and 260 wherein the element is fully inserted into the receptacle 254. While the insertion examples 256, 258, 260 are shown at different steps, it is envisioned that all anode and cathode elements 226, 232 may be actuated simultaneously. Once the anode and cathode elements 226, 232 are partially or fully inserted 258, 260, the RF generator 36 may be continuously or intermittently energized to generate an e-field in the capacitive couplings, which interacts with liquid in the laundry. After e-field energization, the anode and cathode elements 226, 232 may be removed from the respective receptacles 252, 254, and the drum 212 may rotate again.

Additionally, alternate examples of the third embodiment of the invention are envisioned wherein more baffles 22, fewer baffles 22, or each baffle 22 contains a receptacle 252, 254. In this example, the drum 212 may be able to cease rotation at more than one predetermined position. Additionally, it is envisioned that the anode receptacles 252 may be keyed differently than cathode receptacles 254 to prevent a wrong or unintended element 226, 232 from being inserted into a wrong receptacle 252, 254. In yet another example of the third embodiment, or previous embodiments, the laundry treating applicator 10, 110, 210 may have a set of anode and cathode elements 26, 226, 32, 232 in the axial front of the drum 12, 212 and a second set of elements 26, 226, 32, 232 in the axial back of the drum 12, 212. In this example, the laundry treating applicator 10, 110, 210 may independently energize the elements 26, 226, 32, 232 to provide drying of clothing in the front and back of the drum 12, 212, for instance, based on the location of the laundry, or the location of wet or damp laundry.

Figure 8:
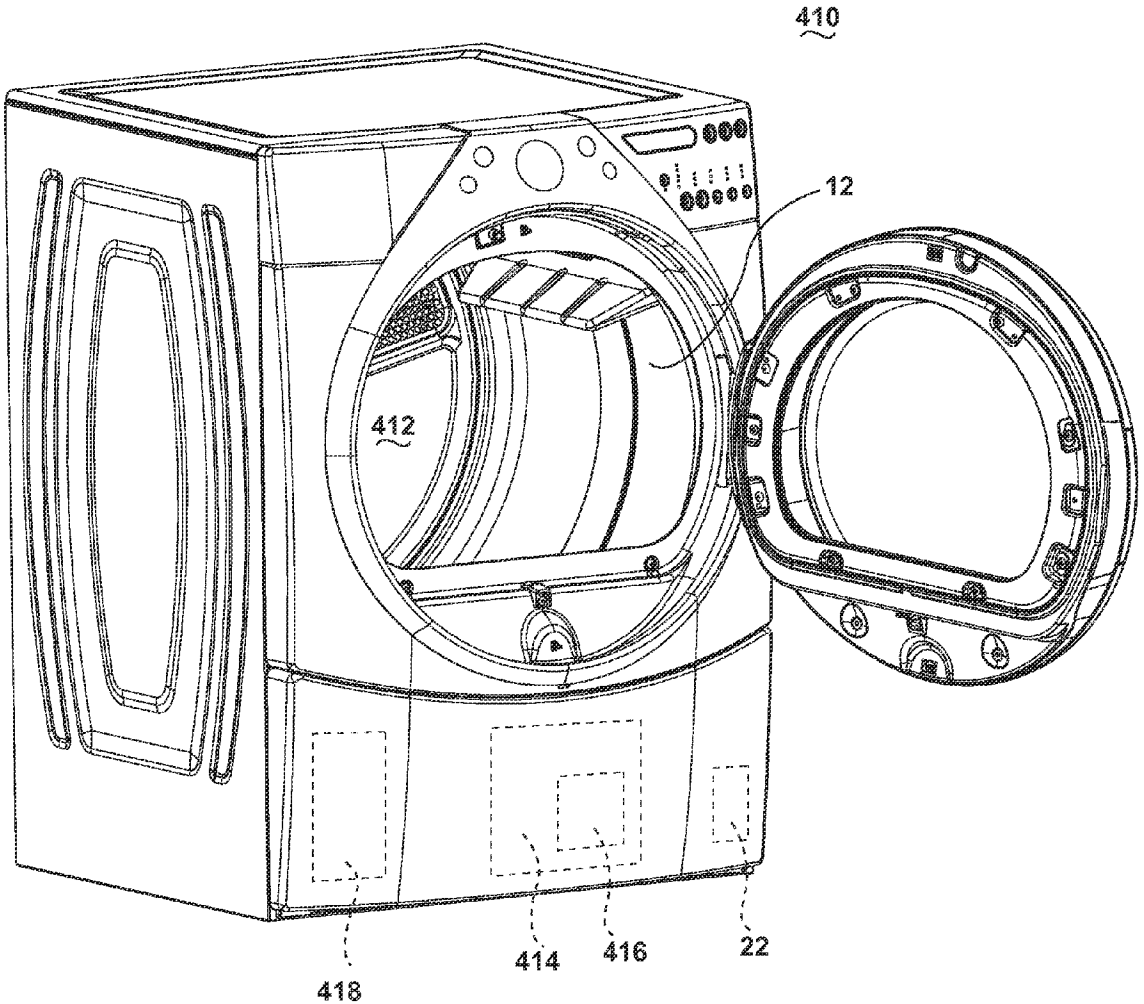
FIG. 8 is a schematic perspective view of an embodiment where the laundry treating applicator is shown as a clothes dryer incorporating the drum of the second, third, and fourth embodiments.

FIG. 8 illustrates an embodiment where the applicator is a laundry treating appliance, such as a clothes dryer 410, incorporating the drum 12, 212 (illustrated as drum 12), which defines a treating chamber 412 for receiving laundry for treatment, such as drying. The clothes dryer comprises an air system 414 supplying and exhausting air from the treating chamber, which includes a blower 416. A heating system 418 is provided for hybrid heating the air supplied by the air system 414, such that the heated air may be used in addition to the dielectric heating. The heating system 418 may work in cooperation with the laundry treating applicator 10, as described herein.

The embodiments disclosed herein provide a laundry treating applicator using an RF generator to dielectrically heat liquid in wet articles to effect a drying of the articles. One advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF generator according to such additional design considerations as efficiency or power consumption during operation.

Additionally, the design of the anode and cathode may be controlled to allow for individual energizing of particular pair of cathode/anode elements inside the applicator in a single or multi-applicator embodiment. The effect of individual energization of particular RF element pairs results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Moreover, the capacitive couplings in embodiments of the invention may allow the drying operations to move or rotate freely without the need for physical connections between the RF generator and the anode and cathode elements. Due to the lack of physical connections, there will be fewer mechanical couplings to moving or rotating embodiments of the invention, and thus, increased applicator reliability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for drying laundry with a radio frequency (RF) generator connected to an applicator having a plurality of baffles on a drum rotatable on a non-vertical axis, an anode element in at least one first baffle and a cathode element in at least one second baffle, the method comprising:

capacitively coupling the anode element to the cathode element; and energizing the RF applicator to generate a field of electromagnetic radiation (e-field) within the radio frequency spectrum between the anode element and the cathode element;

wherein liquid in laundry residing within the e-field will be dielectrically heated to effect a drying of the laundry.

2. The method of claim 1 wherein the capacitively coupling step further comprises coupling at least one anode element to at least one cathode element.

3. The method of claim 1 wherein the e-field is located above at least a portion of an inner surface of the drum and the inner surface supports the laundry.

4. The method of claim 3 wherein a rotation speed of the drum effects a tumble motion of the laundry on the inner surface.

5. The method of claim 3 wherein the energizing step further comprises at least one of intermittent or continuous energization of the RF generator.

6. The method of claim 5 wherein the energizing step further comprises energization of the RF generator while the rotatable drum has stopped rotating.

7. The method of claim 6 wherein the rotatable drum stops rotation in a predetermined position.

8. The method of claim 7 wherein the predetermined position includes the at least one first and second baffles located beneath a horizontal axis.

9. The method of claim 7 wherein the anode and cathode elements are movable, and receivable into receptacles in the respective at least one first and second baffles, and further comprising moving the anode and cathode elements into the receptacles in the respective baffles before energization of the RF generator.

10. The method of claim 5 wherein the rotation of the drum is related to the energization of the RF generator.

11. The method of claim 5, further comprising rotating of the drum during the energization of the RF generator to physically move laundry within the e-field.

12. The method of claim 2 wherein each of the plurality of baffles are circumferentially spaced about the rotatable drum.

13. The method of claim 1 wherein each of the plurality of baffles comprises at least one cathode element or anode element.

14. The method of claim 13 wherein the plurality of baffles alternate cathode and anode elements.

15. The method of claim 14 wherein the energizing step further comprises selective energization of fewer than all of the plurality of baffles.

16. The method of claim 1 wherein the energizing step further comprises a determination of an impedance for the laundry and selective energization of the RF generator in response to determination of the impedance for the laundry.

17. A laundry treating applicator for drying laundry according to a predetermined cycle of operation, comprising:

a laundry support element;

a plurality of baffles at least partially spaced from each other and supported by the laundry support element wherein a first baffle further comprises an anode element and a second baffle further comprises a cathode element;

a capacitive coupling between the anode element and the cathode element; and a radio frequency (RF) generator coupled to the anode element and the cathode element and selectively energized to generate electromagnetic radiation in the radio frequency spectrum;

wherein the energization of the RF generator sends electromagnetic radiation through the applicator via the capacitive coupling to form a field of electromagnetic radiation (e-field) in the radio frequency spectrum to dielectrically heat liquid within laundry within the e-field.

18. The laundry treating appliance of claim 17 wherein the laundry support element comprises a drum with inner and outer surfaces, and the inner surface supports the laundry.

19. The laundry treating appliance of claim 18 wherein the drum is rotatable about a non-vertical axis.

20. The laundry treating appliance of claim 18 wherein the e-field is located above at least a portion of an inner surface of the drum.

21. The laundry treating appliance of claim 17 wherein the RF generator is at least one of intermittently or continuously energizable.

22. The laundry treating appliance of claim 17 wherein each of the plurality of baffles is circumferentially spaced from another of the plurality of baffles about the laundry support element.

23. The laundry treating appliance of claim 22 wherein the plurality of baffles are spaced to provide optimal e-field formation.

24. The laundry treating appliance of claim 17 wherein each of the plurality of baffles comprises at least one cathode element or anode element.

25. The laundry treating appliance of claim 24 wherein the plurality of baffles alternate cathode and anode elements.

26. The laundry treating appliance of claim 24 wherein the anode element has at least one baffle comprising a cathode element on each adjacent side.

* * * * *